US012553650B2

(12) United States Patent
Zardus et al.

(10) Patent No.: US 12,553,650 B2
(45) Date of Patent: Feb. 17, 2026

(54) CENTRIFUGAL FLASH TANK

(71) Applicant: Johnson Controls Tyco IP Holdings LLP, Milwaukee, WI (US)

(72) Inventors: Stephen Maurice Zardus, York, PA (US); Matthew Christopher Ferrero, Shrewsbury, PA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 252 days.

(21) Appl. No.: 17/770,964

(22) PCT Filed: Oct. 23, 2020

(86) PCT No.: PCT/US2020/057134
§ 371 (c)(1),
(2) Date: Apr. 21, 2022

(87) PCT Pub. No.: WO2021/081377
PCT Pub. Date: Apr. 29, 2021

(65) Prior Publication Data

US 2022/0373241 A1 Nov. 24, 2022

Related U.S. Application Data

(60) Provisional application No. 62/925,612, filed on Oct. 24, 2019.

(51) Int. Cl.
*F25B 43/00* (2006.01)

(52) U.S. Cl.
CPC ..... *F25B 43/00* (2013.01); *F25B 2400/02* (2013.01); *F25B 2400/16* (2013.01)

(58) Field of Classification Search
CPC ... F25B 43/00; F25B 2400/02; F25B 2400/16
See application file for complete search history.

(56) References Cited

U.S. PATENT DOCUMENTS 5,502,984 A * 4/1996 Boehde ..... F25B 43/02 210/512.1
6,098,422 A * 8/2000 Tischer ..... F04D 29/2277 62/468

(Continued)

FOREIGN PATENT DOCUMENTS

CN 1804514 A 7/2006
CN 201583073 U 9/2010

(Continued)

OTHER PUBLICATIONS

International Search Report and Written Opinion for PCT Application No. PCT/US2020/057134, mailed Jan. 26, 2021, 13 pgs.

(Continued)

*Primary Examiner* — David J Teitelbaum
(74) *Attorney, Agent, or Firm* — Fletcher Yoder, P.C.

(57) ABSTRACT

A heating, ventilation, and air conditioning (HVAC) system includes a flash tank configured to receive a refrigerant and to separate the refrigerant into vapor refrigerant and liquid refrigerant. The flash tank is configured to generate a flow of refrigerant therein along a circular flow path. The flash tank has a main body having a circular cross-section with a diameter and an inlet coupled to the main body and configured to direct the refrigerant into the main body. The inlet has a center line extending in a common direction with the diameter, and the center line is offset from the diameter in a radial direction.

16 Claims, 6 Drawing Sheets

(56) References Cited

U.S. PATENT DOCUMENTS

| | | | | |
|---|---|---|---|---|
| 6,481,240 | B2 | 11/2002 | Strikis et al. | |
| 6,574,986 | B2 | 6/2003 | Morimoto et al. | |
| 7,086,248 | B2 | 8/2006 | Sakai et al. | |
| 7,131,292 | B2 | 11/2006 | Ikegami et al. | |
| 7,386,994 | B2 * | 6/2008 | Chang | F25B 43/02 62/473 |
| 7,833,298 | B2 | 11/2010 | Larnholm et al. | |
| 7,947,122 | B2 | 5/2011 | Meinander | |
| 8,372,173 | B2 | 2/2013 | Martens | |
| 8,429,930 | B2 | 4/2013 | Valiya Naduvath et al. | |
| 8,590,322 | B2 | 11/2013 | Kusada et al. | |
| 8,974,568 | B2 | 3/2015 | Hofer et al. | |
| 9,233,320 | B2 | 1/2016 | Moen et al. | |
| 9,308,480 | B2 | 4/2016 | Leiss | |
| 9,573,080 | B2 | 2/2017 | Marty et al. | |
| 9,636,691 | B2 | 5/2017 | Chivilikhin et al. | |
| 10,155,188 | B2 | 12/2018 | Yoshioka et al. | |
| 10,197,329 | B2 | 2/2019 | Baxter et al. | |
| 2005/0279128 | A1 * | 12/2005 | Otake | F25B 1/10 62/512 |
| 2006/0280622 | A1 * | 12/2006 | Lee | F25B 43/02 417/313 |
| 2007/0251256 | A1 * | 11/2007 | Pham | F25B 43/006 62/324.1 |
| 2011/0023515 | A1 | 2/2011 | Kopko et al. | |
| 2011/0100040 | A1 * | 5/2011 | Bush | F25B 1/10 62/149 |
| 2011/0174014 | A1 | 7/2011 | Scarcella et al. | |
| 2013/0055751 | A1 * | 3/2013 | Inaba | F25B 6/04 62/498 |
| 2013/0312376 | A1 | 11/2013 | Huff et al. | |
| 2013/0312447 | A1 | 11/2013 | Inaba et al. | |
| 2014/0034260 | A1 | 2/2014 | Nellis et al. | |
| 2014/0352900 | A1 | 12/2014 | Grogan et al. | |
| 2017/0095753 | A1 | 4/2017 | Kim et al. | |
| 2017/0248355 | A1 * | 8/2017 | Knopp | F25B 49/022 |
| 2018/0036653 | A1 | 2/2018 | Ernst et al. | |
| 2018/0296945 | A1 | 10/2018 | Nieuwoudt et al. | |
| 2019/0126171 | A1 | 5/2019 | Xu et al. | |

FOREIGN PATENT DOCUMENTS

| | | | |
|---|---|---|---|
| CN | 101738034 | B | 7/2012 |
| CN | 101493275 | B | 4/2013 |
| CN | 103307815 | A | 9/2013 |
| CN | 203274383 | U | 11/2013 |
| CN | 203731754 | U | 7/2014 |
| CN | 102954636 | B | 12/2014 |
| CN | 203980746 | U | 12/2014 |
| CN | 204767854 | U | 11/2015 |
| CN | 205536724 | U | 8/2016 |
| CN | 205536725 | U | 8/2016 |
| CN | 106215464 | A | 12/2016 |
| CN | 103851843 | B | 11/2017 |
| CN | 207407556 | U | 5/2018 |
| CN | 208475754 | U | 2/2019 |
| JP | 4114337 | B2 | 7/2008 |
| JP | 4167457 | B2 | 10/2008 |
| JP | 2009174738 | A | 8/2009 |
| JP | 2012170863 | A | 9/2012 |
| JP | 5143040 | B2 | 2/2013 |
| JP | 5321512 | B2 | 10/2013 |
| JP | 5366671 | B2 | 12/2013 |
| JP | 2013241902 | A | 12/2013 |
| JP | 5894005 | B2 | 3/2016 |
| JP | 2018015742 | A | 2/2018 |
| RU | 2181859 | C1 | 4/2002 |
| RU | 2290984 | C1 | 1/2007 |
| RU | 94478 | U1 | 5/2010 |
| RU | 98944 | U1 | 11/2010 |
| RU | 2462291 | C1 | 9/2012 |
| RU | 162011 | U1 | 5/2016 |
| RU | 2606977 | A | 1/2017 |
| WO | 2010125055 | A1 | 11/2010 |
| WO | 2011095685 | A1 | 8/2011 |
| WO | 2012017799 | A1 | 2/2012 |
| WO | 2017190852 | A1 | 11/2017 |
| WO | 2018069812 | A1 | 4/2018 |

OTHER PUBLICATIONS

Xueliang Zhou, "CO2 Removal Process Manual for Propylene Carbonate", Zhejiang Science and Technology Press, May 31, 1993, p. 23.

Chinese Office Action for CN Application No. 202080074389.8, dated Feb. 15, 2023, 10 pages.

European Office Action for EP Application No. 20807220.7, dated Oct. 26, 2023, 5 pages.

* cited by examiner

CENTRIFUGAL FLASH TANK

CROSS-REFERENCE TO RELATED APPLICATIONS

This application is a U.S. National Stage Application of PCT Application No. PCT/US2020/057134, entitled "CENTRIFUGAL FLASH TANK," filed Oct. 23, 2020, which claims priority to and the benefit of U.S. Provisional Application No. 62/925,612, entitled "CENTRIFUGAL FLASH TANK," filed Oct. 24, 2019, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof, in response to exposure to different temperatures and pressures within components of the chiller system. The chiller system may place a working fluid in a heat exchange relationship with a conditioning fluid (e.g., water) and may deliver the conditioning fluid to conditioning equipment and/or a conditioned environment of the chiller system. In such applications, the conditioning fluid may be passed through downstream equipment, such as air handlers, to condition other fluids, such as air in a building.

In typical chillers, the conditioning fluid is cooled by an evaporator that absorbs heat from the conditioning fluid by evaporating working fluid. The working fluid is then compressed by a compressor and transferred to a condenser. In the condenser, the working fluid is cooled, typically by a water or air flow, and condensed into a liquid. Air cooled condensers typically include a condenser coil and a fan that forces air flow over the coil. In some conventional designs, economizers are utilized in the chiller design to improve performance. In systems that employ flash tank economizers, the condensed working fluid may be directed to the flash tank where the liquid working fluid at least partially evaporates. The resulting vapor may be extracted from the flash tank and redirected to the compressor, while the remaining liquid working fluid from the flash tank is directed to the evaporator. Unfortunately, existing flash tank economizers may be large and/or expensive. Existing flash tank economizers may also inefficiently separate the working fluid into vapor and liquid components.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and air conditioning (HVAC) system includes a flash tank configured to receive a refrigerant and to separate the refrigerant into vapor refrigerant and liquid refrigerant. The flash tank has a main body having a circular cross-section with a diameter and an inlet coupled to the main body and configured to direct the refrigerant into the main body. The inlet has a center line extending in a common direction with the diameter, and the center line is offset from the diameter in a radial direction.

In another embodiment, an air-cooled chiller system includes a refrigerant circuit configured to circulate a refrigerant, a condenser disposed along the refrigerant circuit and configured to condense the refrigerant, an evaporator disposed along the refrigerant circuit and configured to vaporize the refrigerant, and a flash tank disposed along the refrigerant circuit and configured to separate the refrigerant into vapor refrigerant and liquid refrigerant. The flash tank includes a main body and an inlet coupled to the main body and configured to receive the refrigerant from the refrigerant circuit and direct the refrigerant along a flow path extending from the inlet to an impingement point on an inner wall of the main body. An angle between an axis of the flow path and a tangent line of the main body at the impingement point is less than 90 degrees.

In another embodiment, a chiller system includes a flash tank configured to receive a refrigerant, to at least partially vaporize the refrigerant, and to separate the refrigerant into liquid refrigerant and vapor refrigerant. The flash tank includes an inlet configured direct the refrigerant into an inner volume of the flash tank along a flow path extending from the inlet to an impingement point on an inner wall of the flash tank. A length of the flow path from the inlet to the impingement point is less than a magnitude of a diameter of the flash tank. The inner wall is configured to direct the refrigerant along a circular flow path from the impingement point. The chiller system further includes a condenser configured to direct the refrigerant toward the flash tank, an evaporator configured to receive the liquid refrigerant from the flash tank, and a compressor configured to receive the vapor refrigerant from the flash tank.

DRAWINGS

Various aspects of this disclosure may be better understood upon reading the following detailed description and upon reference to the drawings in which.

DETAILED DESCRIPTION

Figure 1:
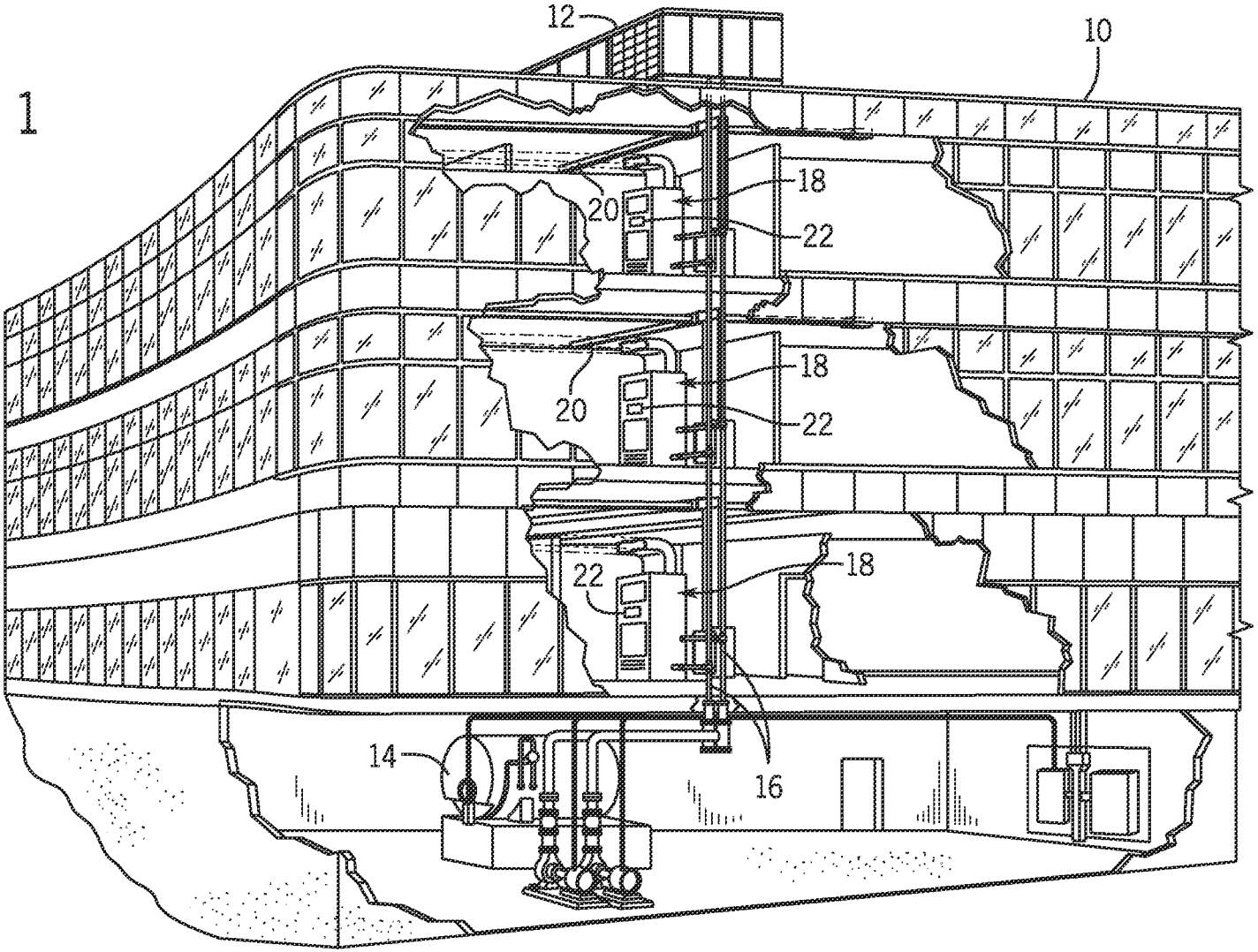
FIG. 1 is a perspective view of a building that may utilize an embodiment of a heating, ventilation, and air conditioning, (HVAC) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to an HVAC system having a flash tank configured to generate circular motion or flow of a two-phase working fluid (e.g., refrigerant) in order to improve separation of the two-phase working fluid into vapor and liquid components. Specifically, the flash tank includes an inlet configured to direct a flow of the two-phase working fluid into the flash tank and tangentially impinge the flow against a curved inner surface (e.g., inner diameter) of the flash tank. For example, the inlet may be formed in the flash tank such that the flow of two-phase working fluid enters the flash tank proximate or tangential to the curved inner surface of the flash tank. Once the flow of two-phase working fluid contacts the curved inner surface, the two-phase working fluid will flow along the curved inner surface in a circular motion about a central axis of the flash tank. The circular motion induces centrifugal forces on the flow of two-phase working fluid. As a result and as described in further detail below, liquid of the two-phase working fluid will be forced radially outward and will collect along the curved inner surface, while vapor of the two-phase working fluid will collect closer toward the center of the flash tank. The vapor working fluid may then exit an outlet of the flash tank formed at a top of the flash tank, and the liquid will travel, via gravity, down the inner curved surface of the flash tank. At the bottom of the flash tank, the liquid working fluid may exit the flash tank separate from the vapor working fluid via another outlet.

It should be understood that, as used herein, mathematical terms, such as "tangential," are intended to encompass features of surfaces or elements as understood to one of ordinary skill in the relevant art and are not limited to their respective definitions as might be understood in the mathematical arts. For example, "tangential" is intended to encompass orientations or directions that extend adjacent or proximate to a tangent line of a circle (e.g., as opposed to extending along a diameter of a circle) or along an edge of a circle.

Turning now to the drawings, FIG. 1 is a perspective view of an embodiment of an application for a heating, ventilation, and air conditioning (HVAC) system. Such systems, in general, may be applied in a range of settings, both within the HVAC field and outside of that field. The HVAC systems may provide cooling to data centers, electrical devices, freezers, coolers, or other environments through vapor-compression refrigeration, absorption refrigeration, or thermoelectric cooling. In presently contemplated applications, however, HVAC systems may be used in residential, commercial, light industrial, industrial, and in any other application for heating or cooling a volume or enclosure, such as a residence, building, structure, and so forth. Moreover, the HVAC systems may be used in industrial applications, where appropriate, for basic cooling and heating of various fluids.

The illustrated embodiment shows an HVAC system for building environmental management that may utilize heat exchangers. A building 10 is cooled by a system that includes a chiller 12 and a boiler 14. As shown, the chiller 12 is disposed on the roof of building 10, and the boiler 14 is located in the basement; however, the chiller 12 and boiler 14 may be located in other equipment rooms or areas next to the building 10. The chiller 12 may be an air cooled or water cooled device that implements a refrigeration cycle to cool water or other conditioning fluid. The chiller 12 (e.g., HVAC system) is housed within a structure that includes a refrigeration circuit, a free cooling system, and associated equipment such as pumps, valves, and piping. For example, the chiller 12 may be single package rooftop unit that incorporates a free cooling system. The boiler 14 is a closed vessel in which water is heated. The water from the chiller 12 and the boiler 14 is circulated through the building 10 by water conduits 16. The water conduits 16 are routed to air handlers 18 located on individual floors and within sections of the building 10.

The air handlers 18 are coupled to ductwork 20 that is adapted to distribute air between the air handlers 18 and may receive air from an outside intake (not shown). The air handlers 18 include heat exchangers that circulate cold water from the chiller 12 and hot water from the boiler 14 to provide heated or cooled air to conditioned spaces within the building 10. Fans within the air handlers 18 draw air through the heat exchangers and direct the conditioned air to environments within building 10, such as rooms, apartments, or offices, to maintain the environments at a designated temperature. A control device, shown here as including a thermostat 22, may be used to designate the temperature of the conditioned air. The control device 22 also may be used to control the flow of air through and from the air handlers 18. Other devices may be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building 10.

Figure 2:
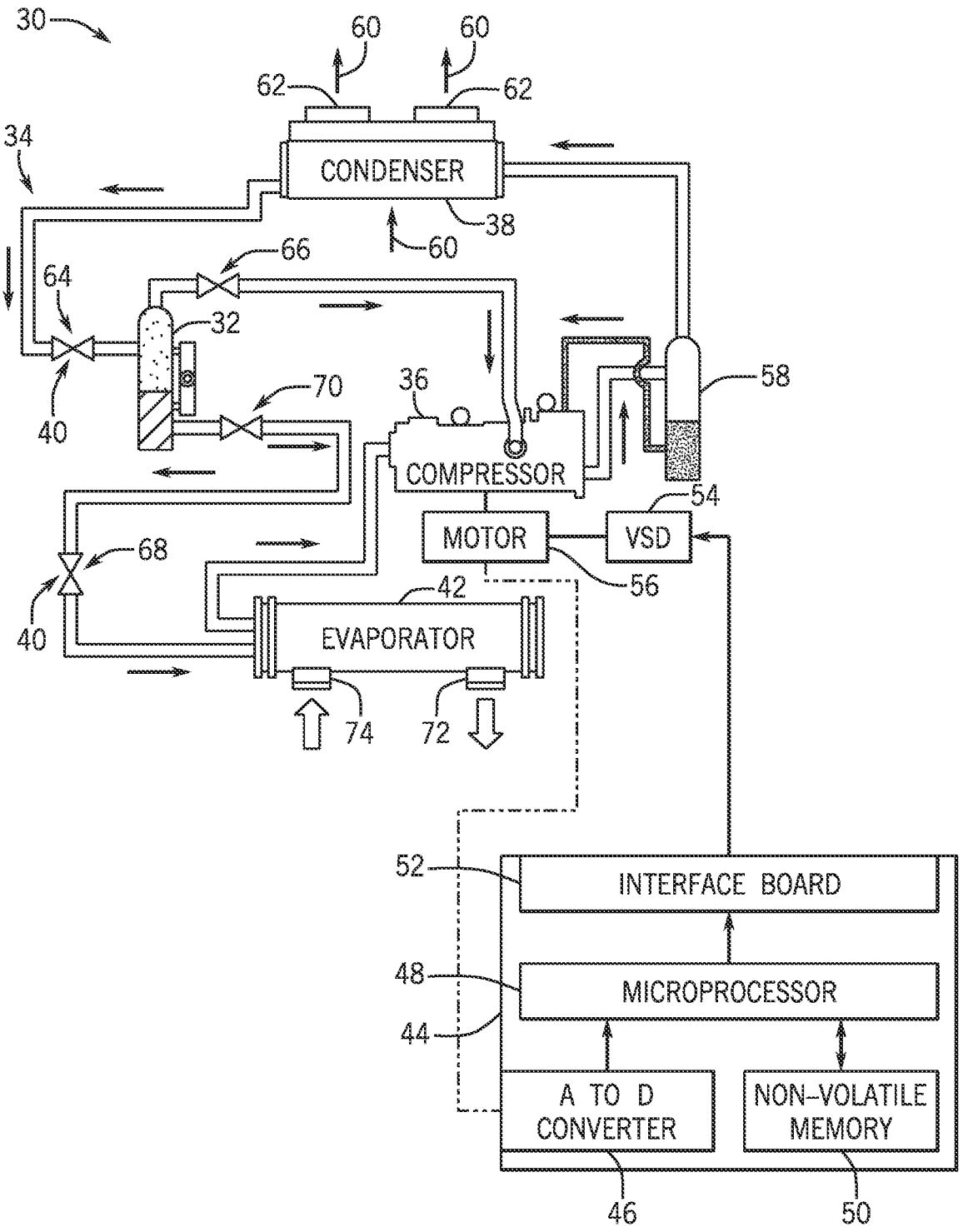
FIG. 2 is a schematic of an embodiment of an HVAC system having a flash tank, in accordance with an aspect of the present disclosure.

FIG. 2 is a schematic of an embodiment of an HVAC system 30 having a flash tank 32 (e.g., economizer tank), in accordance with the present techniques. That is, the flash tank 32 is configured to generate a circular flow of a two-phase refrigerant or working fluid therein to enable improved separation of the two-phase refrigerant into vapor and liquid components. For example, the HVAC system 30 may be an air-cooled chiller. However, it should be appreciated that the disclosed techniques may be incorporated with a variety of other systems that utilize flash tanks.

The HVAC system 30 (e.g., vapor compression system) includes a refrigerant circuit 34 configured to circulate a working fluid, such as refrigerant, therethrough with a compressor 36 (e.g., a screw compressor) disposed along the refrigerant circuit 34. The refrigerant circuit 34 also includes the flash tank 32, a condenser 38, expansion valves or devices 40, and a liquid chiller or an evaporator 42. The components of the refrigerant circuit 34 enable heat transfer between the working fluid and other fluids (e.g., a conditioning fluid, air, water, etc.) in order to provide cooling to an environment, such as an interior of the building 10.

Some examples of working fluids that may be used as refrigerants in the HVAC system 30 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon based refrigerants, water vapor, refrigerants with low global warming potential (GWP), or any other suitable refrigerant. In some embodiments, the HVAC system 30 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

The HVAC system 30 may further include a control panel 44 (e.g., controller) that has an analog to digital (A/D) converter 46, a microprocessor 48, a non-volatile memory 50, and/or an interface board 52. In some embodiments, the HVAC system 30 may use one or more of a variable speed drive (VSDs) 54 and a motor 56. The motor 56 may drive the compressor 36 and may be powered by the VSD 54. The VSD 54 receives alternating current (AC) power having a particular fixed line voltage and fixed line frequency from an AC power source, and provides power having a variable voltage and frequency to the motor 56. In other embodiments, the motor 56 may be powered directly from an AC or direct current (DC) power source. The motor 56 may include any type of electric motor that can be powered by the VSD 54 or directly from an AC or DC power source, such as a switched reluctance motor, an induction motor, an electronically commutated permanent magnet motor, or another suitable motor.

The compressor 36 compresses a refrigerant vapor and may deliver the vapor to an oil separator 58 that separates oil from the refrigerant vapor. The refrigerant vapor is then directed toward the condenser 38, and the oil is returned to the compressor 36. The refrigerant vapor delivered to the condenser 38 may transfer heat to a cooling fluid at the condenser 38. For example, the cooling fluid may be ambient air 60 forced across heat exchanger coils of the condenser 38 by condenser fans 62. The refrigerant vapor may condense to a refrigerant liquid in the condenser 38 as a result of thermal heat transfer with the cooling fluid (e.g., the ambient air 60).

The liquid refrigerant exits the condenser 38 and then flows through a first expansion device 64 (e.g., expansion device 40, electronic expansion valve, etc.). The first expansion device 64 may be a flash tank feed valve configured to control flow of the liquid refrigerant to the flash tank 32. The first expansion device 64 is also configured to lower the pressure of (e.g., expand) the liquid refrigerant received from the condenser 38. During the expansion process, a portion of the liquid may vaporize, and thus, the flash tank 32 may be used to separate the vapor from the liquid received from the first expansion device 64. Additionally, the flash tank 32 may provide for further expansion of the liquid refrigerant because of a pressure drop experienced by the liquid refrigerant when entering the flash tank 32 (e.g., due to a rapid increase in volume experienced when entering the flash tank 32). In accordance with present techniques, the flash tank 32 is configured to enable improved separation of vapor refrigerant from liquid refrigerant in the flash tank 32 via generation of a circular flow or motion of the refrigerant within the flash tank 32. Details of the flash tank 32 are discussed below with reference to FIGS. 3-6.

The vapor in the flash tank 32 may exit and flow to the compressor 36. For example, the vapor may be drawn to an intermediate stage or discharge stage of the compressor 36 (e.g., not the suction stage). A valve 66 (e.g., economizer valve, solenoid valve, etc.) may be included in the refrigerant circuit 34 to control flow of the vapor refrigerant from the flash tank 32 to the compressor 36. In some embodiments, when the valve 66 is open (e.g., fully open) additional liquid refrigerant within the flash tank 32 may vaporize and provide additional subcooling of the liquid refrigerant within the flash tank 32. The liquid refrigerant that collects in the flash tank 32 may be at a lower enthalpy than the liquid refrigerant exiting the condenser 38 because of the expansion in the first expansion device 64 and/or the flash tank 32. The liquid refrigerant may flow from the flash tank 32, through a second expansion device 68 (e.g., expansion device 40, an orifice, etc.), and to the evaporator 42. In some embodiments, the refrigerant circuit 34 may also include a valve 70 (e.g., drain valve) configured to regulate flow of liquid refrigerant from the flash tank 32 to the evaporator 42. For example, the valve 70 may be controlled (e.g., via the control board 44) based on an amount of suction superheat of the refrigerant.

The liquid refrigerant delivered to the evaporator 42 may absorb heat from another cooling fluid, which may or may not be the same cooling fluid used in the condenser 38. The liquid refrigerant in the evaporator 42 may undergo a phase change to become vapor refrigerant. For example, the evaporator 42 may include a tube bundle fluidly coupled to a supply line 72 and a return line 74 that are connected to a cooling load. The cooling fluid of the evaporator 42 (e.g., water, ethylene glycol, calcium chloride brine, sodium chloride brine, or any other suitable fluid) enters the evaporator 42 via the return line 74 and exits the evaporator 42 the via supply line 72. The evaporator 42 may reduce the temperature of the cooling fluid in the tube bundle via thermal heat transfer with the refrigerant so that the cooling fluid may be utilized to provide cooling for a conditioned environment. The tube bundle in the evaporator 42 can include a plurality of tubes and/or a plurality of tube bundles. In any case, the refrigerant vapor exits the evaporator 42 and returns to the compressor 36 by a suction line to complete the refrigerant cycle.

Figure 3:
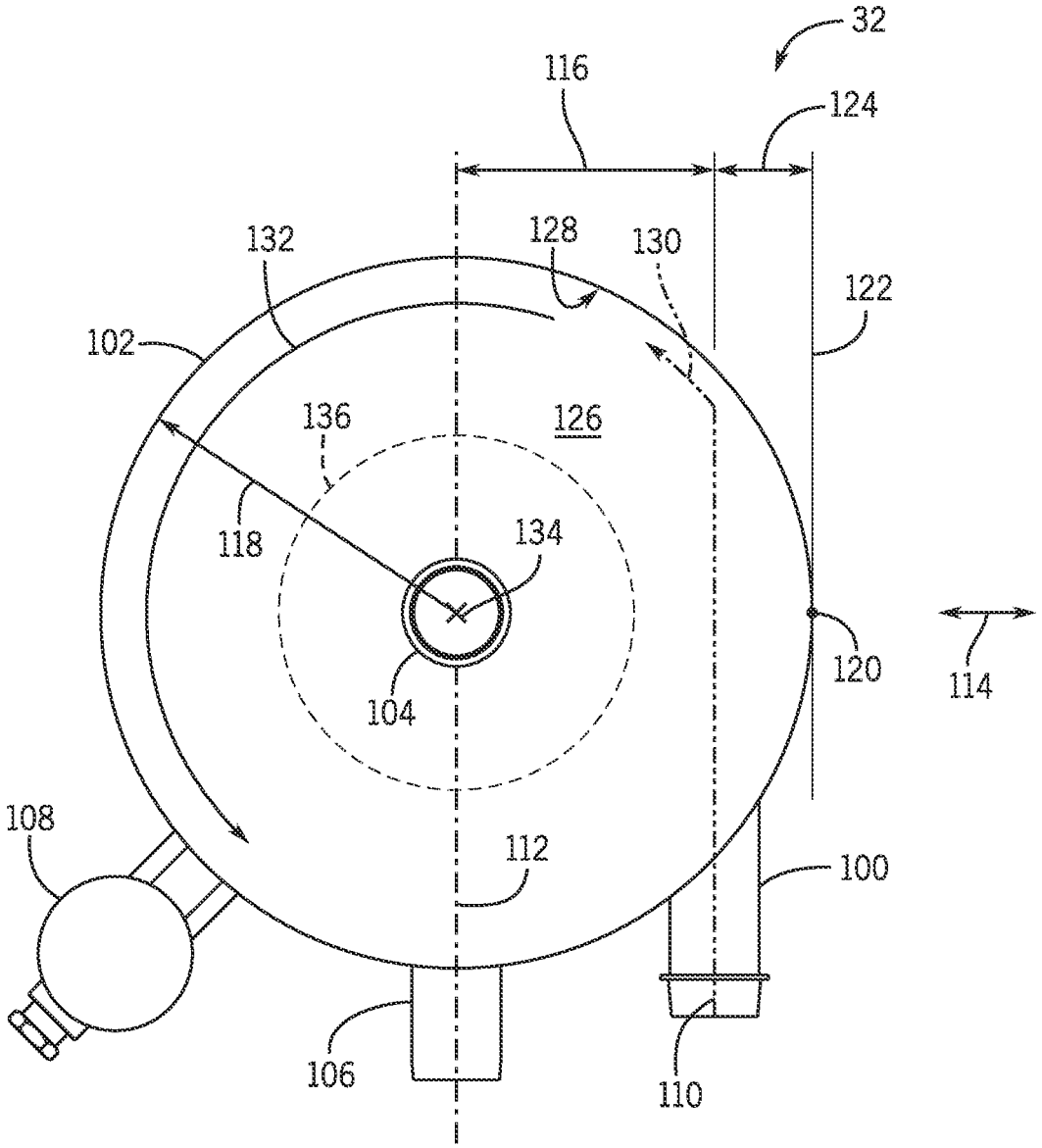
FIG. 3 is a top view of an embodiment of a flash tank for an HVAC system, in accordance with an aspect of the present disclosure.

FIG. 3 is a top view of an embodiment of the flash tank 32 that is configured to generate or induce a circular flow of refrigerant or other working fluid received by the flash tank 32. To that end, the flash tank 32 includes an inlet 100 (e.g., tangential inlet, linear conduit, linear inlet) configured to direct refrigerant flow into the flash tank 32, such that the refrigerant flow impinges on an inner curved surface of the flash tank 32 and is directed along the inner curved surface in a circular motion within the flash tank 32. The circular motion or flow of the refrigerant (e.g., two-phase refrigerant) induces forces (e.g., centrifugal forces) that improve separation of liquid refrigerant particles from vapor refrigerant particles. As a result, the flash tank 32 enables a higher mass flow rate of refrigerant per unit volume of the flash tank 32, which thereby enables size reduction, and thus cost savings, of the flash tank 32.

The flash tank 32 includes a main body 102 (e.g., vessel, canister, etc.) having a generally circular cross-section. For example, the main body 102 may have a generally cylindrical configuration. In addition to the inlet 100, the flash tank 32 includes a vapor outlet (e.g., first outlet) 104, a liquid outlet (e.g., second outlet) 106, and a level indicator 108. In some embodiments, one or more of the inlet 100, the vapor outlet 104, and the liquid outlet 106 may be a tube or conduit having a cylindrical or circular configuration. As shown more clearly in FIG. 6, the vapor outlet 104 may be formed at a top of the main body 102, and the liquid outlet 106 maybe formed proximate a bottom of the main body 102 (e.g., on a side of the main body 102). In operation, refrigerant (e.g., two-phase refrigerant leaving the first expansion device 64) enters the main body 102 of the flash tank 32 via the inlet 100. Within the main body 102, the refrigerant is separated into vapor refrigerant and liquid refrigerant components, which ultimately exit the flash tank 32 via the vapor outlet 104 and the liquid outlet 106, respectively.

The position of the inlet 100 relative to the main body 102 causes the refrigerant entering the flash tank 32 to flow in a circular motion or path within the main body 102. For example, in the illustrated embodiment, the inlet 100, which has a center line 110, is offset from a diameter 112 of the main body 102, where the center line 110 and the diameter 112 generally extend in a common direction. That is, the center line 110 of the inlet 100 and the diameter 112 are offset from one another along a radial axis 114 (e.g., a direction perpendicular to the diameter 112). In some embodiments, the center line 110 and the diameter 112 may be parallel with one another or substantially parallel with one another (e.g., within 1, 2, 5, 10, 15, or 20 degrees).

The inlet 100 (e.g., the center line 110) is offset from the diameter 112 along the radial axis 114 by a distance 116. In some embodiments, the distance 116 may be equal to at least 50 percent, 60 percent, 70 percent, 80 percent, or more of a magnitude of a radius 118 of the main body 102 and/or equal to at least 25 percent, 30 percent, 35 percent, 40 percent, or more of a magnitude of the diameter 112 of the main body 102. As a result, the inlet 100 is positioned proximate a radially outermost point 120 of the main body 102 from the diameter 112 and along the radial axis 114. The center line 110 on the inlet 100 also extends in a common direction (e.g., parallel or substantially parallel) with a tangent line 122 extending through the radially outermost point 120. For example, the inlet 100 (e.g., the center line 110) may be offset from the tangent line 122 along the radial axis 114 by a distance 124, which is less than the distance 116 by which the center line 110 is offset from the diameter 112.

Due to the positioning of the inlet 100 relative to the main body 102, refrigerant entering the main body 102 (e.g., into an inner volume 126 of the flash tank 32), will flow along the center line 110 and will impinge against an inner wall 128 (e.g., curved inner wall, inner diameter, etc.) of the main body 102, as indicated by dashed line 130. As discussed in further detail below with reference to FIG. 4, the refrigerant contacts the inner wall 128 at a location angled gradually relative to the direction of the refrigerant flow (e.g., along the center line 110). As a result, flow losses in the refrigerant, which enters the flash tank 32 at a high velocity, are reduced. Additionally, the refrigerant is directed in a circular flow pattern or path, as indicated by line 132, within the main body 102.

The circular flow pattern of the refrigerant induces forces, such as centrifugal forces, in the refrigerant that improve separation of the liquid and vapor particles of the refrigerant. As will be appreciated, liquid refrigerant particles within a two-phase refrigerant have a higher density than vapor refrigerant particles. Thus, centrifugal forces induced in the two-phase refrigerant more readily act on the liquid refrigerant particles and force the liquid refrigerant particles radially outward relative to a central axis 134 of the main body 102. The liquid refrigerant particles may collect on the inner wall 128 of the main body 102, and gravity may force the liquid refrigerant particles down the inner wall 128 toward the liquid outlet 106 near the bottom of the flash tank 32. Meanwhile, lower density vapor refrigerant particles of the two-phase refrigerant may be less affected by the induced forces and may instead collect in a central region 136 of the inner volume 126. Indeed, the collection of the liquid refrigerant along the inner wall 128 of the main body 102 may generate a lower pressure within the central region 136 that draws or forces the vapor refrigerant to the central region 136. As the lower density vapor refrigerant is less affected by gravity, the vapor refrigerant may more readily exit the flash tank 32 from the central region 136 via the vapor outlet 104 at the top of the flash tank 32.

Figure 4:
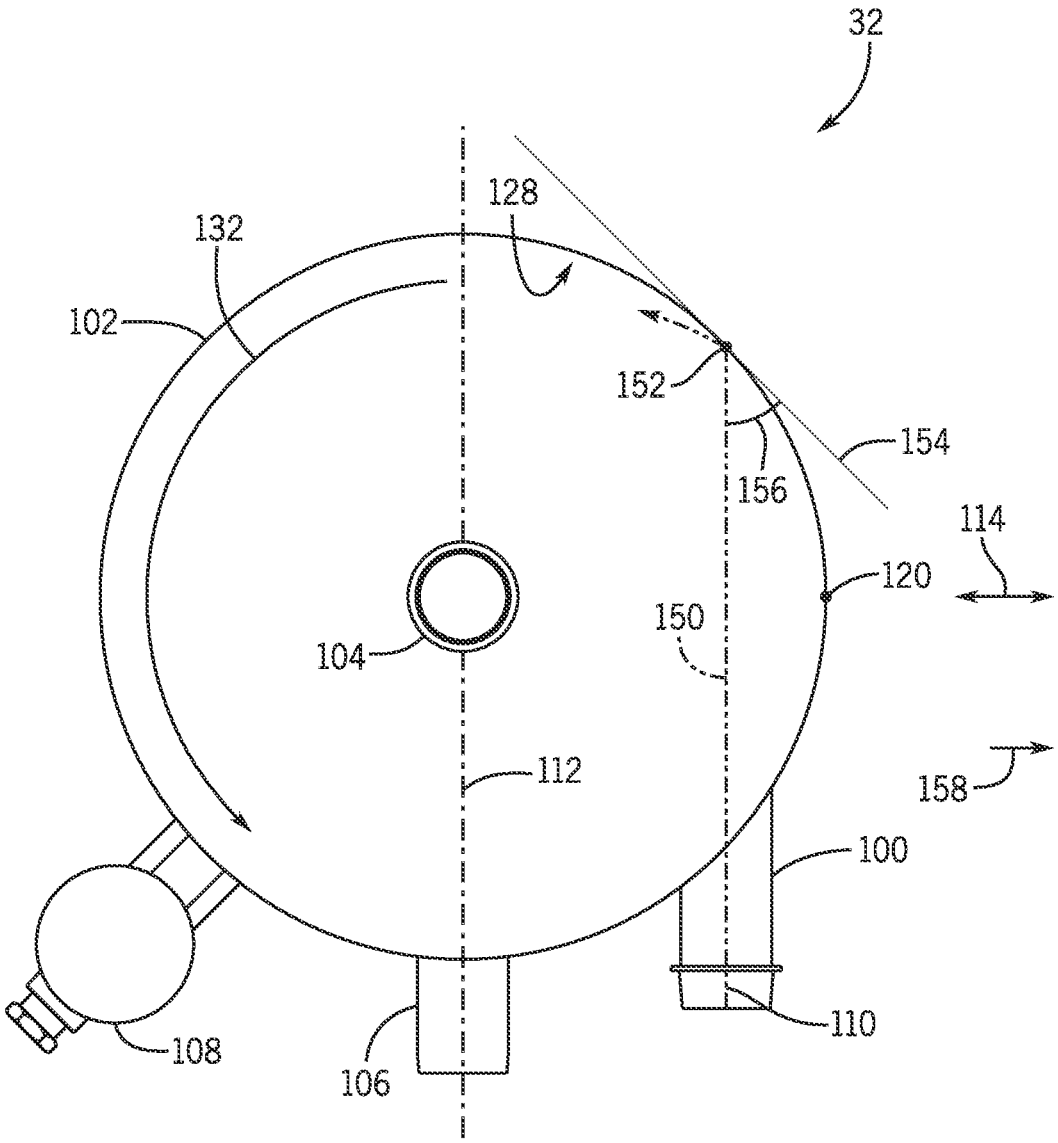
FIG. 4 is a top view of an embodiment of a flash tank for an HVAC system, in accordance with an aspect of the present disclosure.

FIG. 4 is a top view of an embodiment of the flash tank 32 that is configured to generate or induce a circular flow of refrigerant or other working fluid received by the flash tank 32, illustrating an angle at which the refrigerant entering the main body 102 may impinge against the inner wall 128. As the two-phase refrigerant enters the main body 102 via the inlet 100 at a high velocity, the refrigerant may flow along a flow path 150 generally collinear with the center line 110 of the inlet 100 until the refrigerant contacts the inner wall 128 at an impingement point 152. As shown, a length of the flow path 150 from the inlet 100 at the inner wall 128 to the impingement point 152 is less than a magnitude of the diameter 112. As similarly described above, the inner wall 128 of the main body 102 deflects the refrigerant at the impingement point 152, such that the refrigerant begins to flow along the circular flow path 132 within the flash tank 32.

A tangent line 154 intersects with the impingement point 152 and forms an angle (e.g., acute angle) 156 with the flow path 150 (e.g., an axis of the flow path 150). The angle 156 at which the refrigerant contacts the inner wall 128 (e.g., curved inner wall) enables the inner wall 128 to direct the refrigerant along the circular flow path 132 and reduce flow losses (e.g., loss of velocity) of the refrigerant. Refrigerant flow along the circular flow path 132 also enables improved separation of the liquid and vapor refrigerant components in the manner described above. Thus, refrigerant may be delivered to the flash tank 32 at a higher mass flow rate per unit volume of the flash tank 32, thereby enabling a reduction in the size and cost of the flash tank 32.

As will be appreciated, as the position of the inlet 100 is moved closer to the radially outermost point 120 of the main body 102 from the diameter 112 and along the radial axis 114 (e.g., in a direction 158), the magnitude of the angle 156 may decrease. In some embodiments, the position of the inlet 100 may be selected to achieve a desired value of the angle 156. For example, the inlet 100 may be formed on the main body 102 to achieve a value of the angle 156 that is less than 60 degrees, less than 50 degrees, less than 40 degrees, less than 30 degrees, or any other suitable angle.

Figure 5:
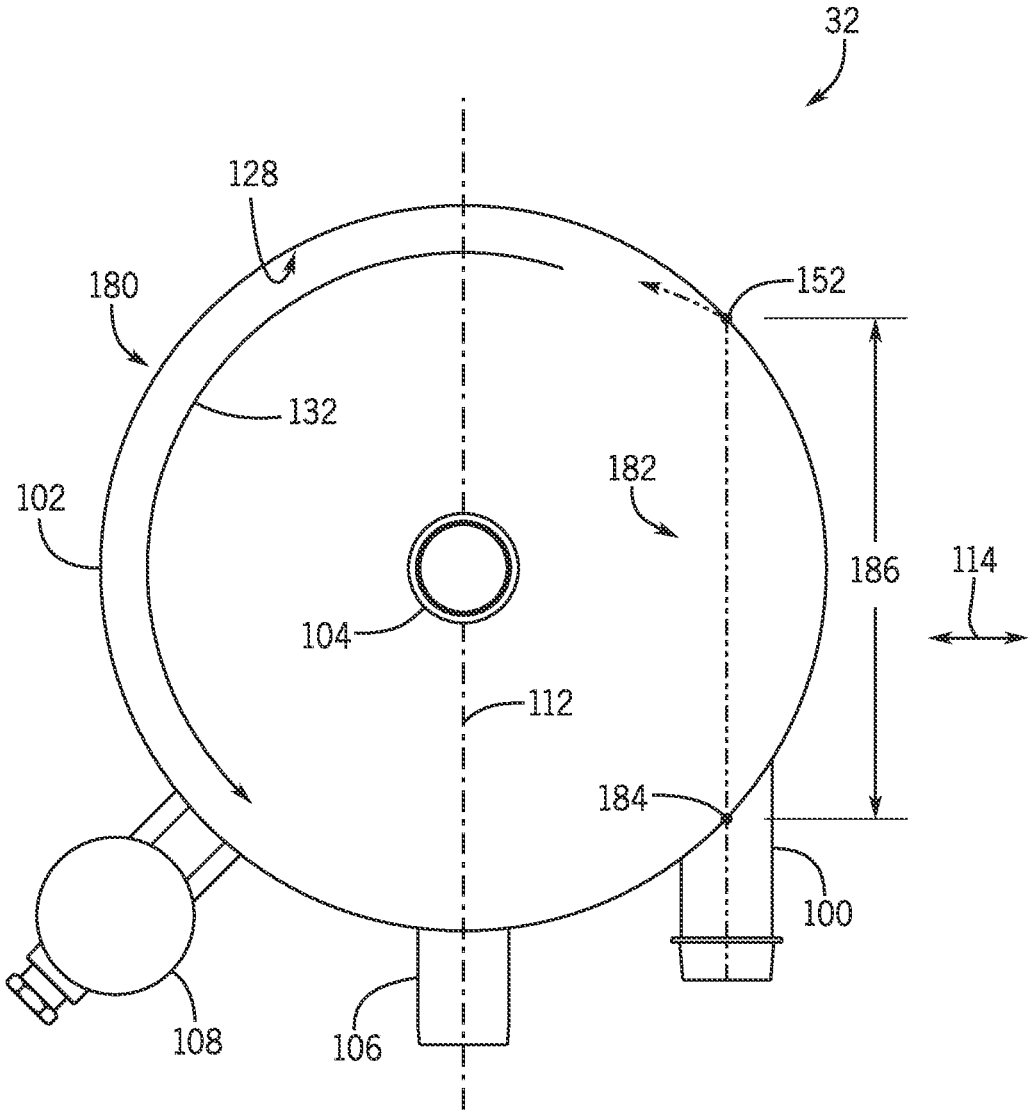
FIG. 5 is a top view of an embodiment of a flash tank for an HVAC system, in accordance with an aspect of the present disclosure.

FIG. 5 is a top view of an embodiment of the flash tank 32 that is configured to generate or induce a circular flow of refrigerant or other working fluid received by the flash tank 32, illustrating a flow path of the refrigerant entering the flash tank 32 via the inlet 100. The inlet 100 is coupled to an outer surface 180 of the main body 102 of the flash tank 32. As mentioned above, the main body 102 may have a circular cross-section. As such, the inlet 100 is coupled to the outer surface 180 along a circumference of the main body 102.

The inlet 100 is a conduit that directs refrigerant flow from the refrigerant circuit 34 (e.g., piping of the refrigerant circuit 34) into the inner volume 126 of the flash tank 32. The refrigerant leaves the inlet 100 and travels along an initial flow path 182 within the inner volume 126. Specifically, the initial flow path 182 may begin at an entry point 184 where the refrigerant passes from the inlet 100 to the inner volume 126. Indeed, the entry point 184 may be a hole or aperture formed in the main body 102 that is surrounded by the inlet 100 coupled to the main body 102 on the outer surface 180. The refrigerant continues along the initial flow path 182 until contacting the inner wall 128 of the main body 102 at the impingement point 152. As mentioned above, the center line 110 of the inlet 100 and the diameter 112 of the main body 102 are offset from one another along the radial axis 114 (e.g., a direction perpendicular to the diameter 112). Thus, a distance 186 from the entry point 184 to the impingement point 152 is less than a distance of the diameter 112. For example, the initial flow path 182 may be described as extending along a "chord" of the circumference of the main body 102, and the center line 110 of the inlet 100 extends along a "secant" including the "chord" representative of the initial flow path 182. After contacting the inner wall 128 at the impingement point 152, the refrigerant may be directed along the circular flow path 132 by the inner wall 128 in the manner described above.

Figure 6:
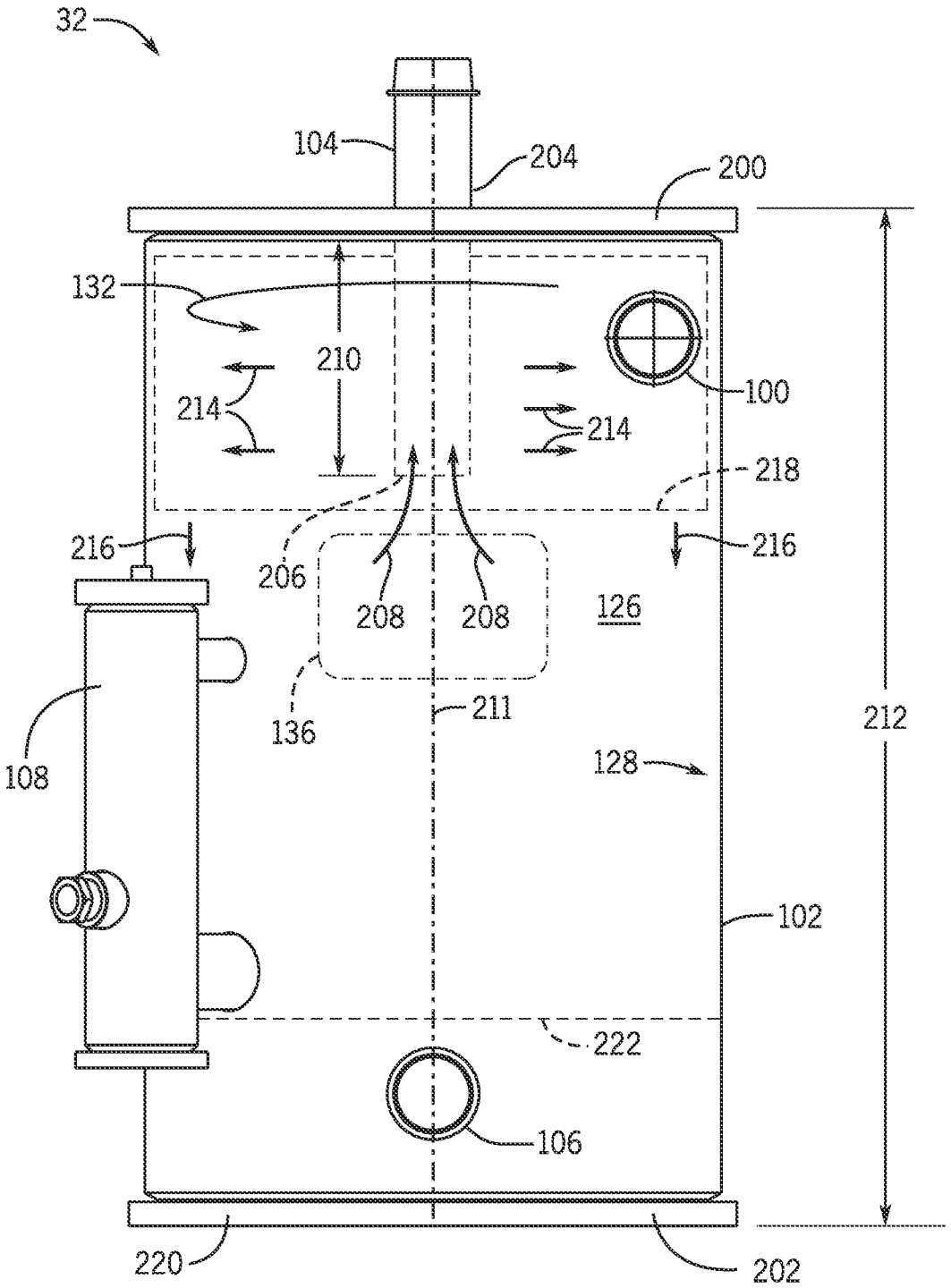
FIG. 6 is a side view of an embodiment of a flash tank for an HVAC system, in accordance with an aspect of the present disclosure.

FIG. 6 is a side view of an embodiment of the flash tank 32 that is configured to generate or induce a circular flow of refrigerant or other working fluid received by the flash tank 32. As described above, refrigerant (e.g., two-phase refrigerant) is directed into the flash tank 32 via the inlet 100, and refrigerant exits the flash tank 32 via the vapor outlet 104 and the liquid outlet 106 as vapor refrigerant and liquid refrigerant, respectively. The separation of the refrigerant into vapor refrigerant and liquid refrigerant is improved due to the flow of the refrigerant along the circular flow path 132 that is enabled by the tangential position of the inlet 100 along the outer surface 180 of the main body 102.

In the illustrated embodiment, the flash tank 32 includes a top 200 (e.g., top plate) and a bottom 202 (e.g., bottom plate) positioned on opposite ends of the main body 102. The vapor outlet 104 is a conduit 204 that extends through the top 200 (e.g., at a center of the top 200 and/or along the central axis 134 of the flash tank 32) and is configured to direct vapor refrigerant from the inner volume 126 toward the compressor 36 of the HVAC system 30. To this end, the conduit 204 includes an open end 206 (e.g., distal end) positioned within the inner volume 126. Refrigerant vapor may enter the conduit 204 of the vapor outlet 104 via the open end 206, as indicated by arrows 208.

As shown, the conduit 204 of the vapor outlet 104 also extends into the inner volume 126 of the main body 102 by a distance 210 along a longitudinal axis 211 of the flash tank 32. A magnitude of the distance 210 may be selected based on various operating or design parameters of the flash tank 32. For example, a magnitude of the distance 210 may be selected based on operating parameters of the refrigerant, such as flow rate, pressure, temperature, and so forth. In some embodiments, the magnitude of the distance 210 may be selected based on an overall size of the flash tank 32. For example, the magnitude of the distance 210 may be approximately 20 percent, 25 percent, 30 percent, 33 percent, 35 percent, or 40 percent of a total vertical height 212 from the bottom 202 to the top 200 of the flash tank 32.

In operation, the refrigerant (e.g., two-phase refrigerant) enters the main body 102 via the inlet 100, which is positioned proximate the top 200 of the flash tank 32. In the manner described above, the refrigerant is directed to flow along the circular flow path 132 within the inner volume 126 of the main body 102. As a result, forces (e.g., centrifugal forces) are induced within the refrigerant, which enables improved separation of the liquid refrigerant and the vapor refrigerant. More specifically, the higher density liquid refrigerant particles may be forced radially outward and may collect along the inner wall 128, as indicated by arrows 214. Thereafter, the force of gravity may cause the liquid refrigerant particles to travel downward toward the bottom 202 of the flash tank 32, as indicated by arrows 216. At the base of the flash tank 32, liquid refrigerant may be directed through the liquid outlet 106 toward the evaporator 42 disposed along the refrigerant circuit 34. The lower density vapor refrigerant particles, on the other hand, may collect in the central region 136 (e.g., low pressure region below the open end 206 along the longitudinal axis 211) of the inner volume 126 and may exit the flash tank 32, as indicated by arrows 208. In some embodiments, the refrigerant may initially separate into vapor and liquid components while flowing along the circular flow path 132 within a separation zone 218 of the inner volume 126. For example, the separation zone 218 may extend within the inner wall 128 and along the longitudinal axis 211 from the top 200 of the main body 102 to the open end 206 of the conduit 204. The inlet 100 is coupled to the main body 102 between the top 200 and the open end 206 relative to the longitudinal axis 211 (e.g., within the separation zone 218). Thus, the magnitude of the distance 210 by which the conduit 204 of the vapor outlet 104 extends into the inner volume 126 may affect a size of the separation zone 218 and the separation of the refrigerant into vapor and liquid components.

In some embodiments, the flash tank 32 may not include additional structural elements within the inner volume 128, thereby simplifying construction of the flash tank 32. For example, the flash tank 32 may not include additional plates, crossbars, rings, or other structural features, which may enable less restricted refrigerant flow. To this end, certain features of the flash tank 32, such as a base plate 220 of the bottom 202 of the flash tank 32, may be reinforced to provide structural rigidity. However, other embodiments of the flash tank 32 may include other internal features. For example, the flash tank 32 may include a baffle plate 222 positioned proximate the bottom 202 of the main body 102. The baffle plate 222 may function as a barrier or shield between liquid refrigerant collected at the bottom 202 of the flash tank 32 and the central region 136 (e.g., low pressure region) of the inner volume 126.

As discussed above, embodiments of the present disclosure relate to an HVAC system having a flash tank configured to generate circular motion or flow of a two-phase refrigerant in order to improve separation of the two-phase refrigerant into vapor and liquid components. Specifically, the flash tank includes an inlet configured to direct a flow of the two-phase refrigerant into the flash tank and tangentially impinge the flow against a curved inner surface of the flash tank. For example, the inlet may be formed in the flash tank such that the flow of two-phase refrigerant enters the flash tank proximate or tangential to the curved inner surface of the flash tank. Once the flow of two-phase refrigerant contacts the curved inner surface, the two-phase refrigerant flows along the curved inner surface in a circular motion about a central axis of the flash tank. The circular motion induce centrifugal forces on the flow of two-phase refrigerant. As a result, higher density liquid particles of the two-phase refrigerant will be forced radially outward and will collect along the curved inner surface, while lower density vapor particles of the two-phase refrigerant will collect closer toward the center of the flash tank. The vapor refrigerant may then exit an outlet of the flash tank formed at a top of the flash tank, and the liquid refrigerant will travel, via gravity, down the inner curved surface of the flash tank. At the bottom of the flash tank, the liquid refrigerant may exit the flash tank separate from the vapor refrigerant. Embodiments of the flash tank disclosed herein enable higher mass flow rates of refrigerant into and through the flash tank without increasing a size of the flash tank.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilating, and air conditioning (HVAC) system, comprising:

a flash tank configured to receive a refrigerant and to separate the refrigerant into vapor refrigerant and liquid refrigerant;

a main body of the flash tank, wherein the main body comprises a circular cross-section having a diameter;

an inlet of the flash tank coupled to the main body and configured to direct the refrigerant into the main body, wherein the inlet is a linear conduit comprising a center line extending in a common direction with the diameter, and the center line is offset from the diameter in a radial direction;

a first outlet of the flash tank configured to direct the vapor refrigerant out of the flash tank, wherein the first outlet comprises a conduit extending through a top plate of the main body and into an inner volume of the flash tank, and wherein the conduit extends from the top plate into the inner volume of the flash tank by a distance, and the distance is between 30 and 35 percent of a total height of the flash tank; and a second outlet of the flash tank configured to direct the liquid refrigerant out of the flash tank; and an evaporator configured to receive the liquid refrigerant from the second outlet of the flash tank, wherein the evaporator is configured to place the liquid refrigerant in a heat exchange relationship with a flow of liquid cooling fluid.

2. The HVAC system of claim 1, wherein the conduit comprises an open end disposed within the inner volume of the flash tank, wherein the inlet of the flash tank is coupled to the main body between the top plate and the open end along a longitudinal axis of the flash tank.

3. The HVAC system of claim 1, comprising a refrigerant circuit coupled to the flash tank, wherein the refrigerant circuit is configured to direct the refrigerant from a condenser of the HVAC system to the inlet, the refrigerant circuit is configured to direct the vapor refrigerant from the first outlet to a compressor of the HVAC system, and the refrigerant circuit is configured to direct the liquid refrigerant from the second outlet to the evaporator of the HVAC system.

4. The HVAC system of claim 1, wherein the distance is a first distance, wherein the center line is offset from the diameter in the radial direction by a second distance, and wherein the second distance is equal to or greater than 25 percent of a magnitude of the diameter.

5. The HVAC system of claim 1, wherein the HVAC system is an air-cooled chiller.

6. The HVAC system of claim 1, wherein the inlet is configured to direct the refrigerant into the main body along a flow path extending from the inlet to an impingement point on an inner wall of the main body, wherein an angle between an axis of the flow path and a tangent line of the main body at the impingement point is less than 90 degrees.

7. The HVAC system of claim 6, wherein the angle between the axis of the flow path and the tangent line of the main body at the impingement point is less than 60 degrees.

8. An air-cooled chiller system, comprising:

a refrigerant circuit configured to circulate a refrigerant;

a condenser disposed along the refrigerant circuit and configured to condense the refrigerant;

an evaporator disposed along the refrigerant circuit and configured to vaporize the refrigerant; and a flash tank disposed along the refrigerant circuit and configured to separate the refrigerant into vapor refrigerant and liquid refrigerant, wherein the flash tank comprises:

a main body;

an inlet coupled to the main body and configured to receive the refrigerant from the refrigerant circuit and direct the refrigerant along a flow path extending from the inlet to an impingement point on an inner wall of the main body, wherein an angle between an axis of the flow path and a tangent line of the main body at the impingement point is less than 60 degrees; and a liquid outlet formed on a side of the main body and configured to direct the liquid refrigerant from the main body toward the evaporator, wherein the liquid outlet extends in a common direction with a diameter of the main body.

9. The system of claim 8, wherein the flash tank comprises a vapor outlet configured to direct the vapor refrigerant from the main body toward a compressor disposed along the refrigerant circuit.

10. The system of claim 9, wherein the vapor outlet comprises a conduit extending from a top plate of the flash tank into an inner volume of the flash tank.

11. The system of claim 10, wherein the conduit extends from the top plate of the flash tank into the inner volume of the flash tank by a length equal to between 30 percent and 35 percent of a height of the flash tank.

12. The system of claim 11, wherein the inlet is disposed along the height of the flash tank between the top plate and a distal end of the conduit within the inner volume.

13. A chiller system, comprising:

a flash tank configured to receive a refrigerant, to at least partially vaporize the refrigerant, and to separate the refrigerant into liquid refrigerant and vapor refrigerant, wherein the flash tank comprises:

a level indicator coupled to an outer surface of the flash tank; and an inlet configured to direct the refrigerant into an inner volume of the flash tank along a flow path extending from the inlet to an impingement point on an inner wall of the flash tank, wherein the inlet comprises a center line extending in a common direction with a diameter of the flash tank, wherein the center line is offset from the diameter of the flash tank in a radial direction by a distance, wherein the distance is equal to or greater than 25 percent of a magnitude of the diameter of the flash tank, wherein a length of the flow path from the inlet to the impingement point is less than the magnitude of the diameter of the flash tank, and wherein the inner wall is configured to direct the refrigerant along a circular flow path from the impingement point;

a condenser configured to direct the refrigerant toward the flash tank;

an evaporator configured to receive the liquid refrigerant from the flash tank; and a compressor configured to receive the vapor refrigerant from the flash tank.

14. The chiller system of claim 13, wherein the inner wall at the impingement point is configured to direct the refrigerant along the inner wall in the circular flow path.

15. The chiller system of claim 13, comprising an outlet conduit extending through a top plate of the flash tank and into the inner volume of the flash tank, wherein the outlet conduit is configured to direct the vapor refrigerant from the inner volume toward the compressor, and wherein a length of the outlet conduit from the top plate to a distal end of the outlet conduit within the inner volume is at least 25 percent of a total height of the flash tank.

16. The chiller system of claim 13, wherein the evaporator is configured to place the liquid refrigerant in a heat exchange relationship with a flow of liquid cooling fluid.

* * * * *